US006070748A

United States Patent [19]

Storar

[11] Patent Number: 6,070,748

[45] Date of Patent: Jun. 6, 2000

[54] BREAK AWAY OVERCAP

[75] Inventor: James R. Storar, Buena, N.J.

[73] Assignee: Comar, Inc., Buena, N.J.

[21] Appl. No.: 09/201,637

[22] Filed: Nov. 30, 1998

Related U.S. Application Data

[63] Continuation of application No. 09/023,787, Feb. 13, 1998, Pat. No. 5,901,866, which is a continuation-in-part of application No. 08/713,028, Sep. 12, 1996, Pat. No. 5,718,348.

[51] Int. Cl.[7] ..... B65D 41/00

[52] U.S. Cl. ..... 215/249; 215/251

[58] Field of Search ..... 215/249, 251

[56] References Cited

U.S. PATENT DOCUMENTS

| | | | |
|---|---|---|---|
| 4,433,790 | 2/1984 | Gibson | 215/246 |
| 4,482,071 | 11/1984 | Ishiwatari | 215/255 |
| 4,520,942 | 6/1985 | Dwinell | 220/257 |
| 4,984,699 | 1/1991 | Zalut | 215/231 |
| 5,611,445 | 3/1997 | Kano et al. | 215/249 |

*Primary Examiner*—Stephen K. Cronin
*Attorney, Agent, or Firm*—Eugene E. Renz, Jr. PC

[57] ABSTRACT

A break away overcap (1) is used for maintaining a closure (6) in sealing engagement with the open end of a vial (2). The overcap (1) is molded from a fracturable plastic and is provided with a pair of spaced, parallel score lines or V-grooves (5) extending across the top wall (3) of the overcap (1) and downwardly of the cap skirt (4) to the lower edge thereof on each side of the cap. Thumb and finger engaging portions (4*a*) are provided at the lower edge of the skirt (4) adjacent the terminal ends of the score lines (5) so that by pushing inwardly on the thumb and finger engaging portions, (4*a*) the overcap (1) breaks into three pieces to thereby expose the closure (6) for insertion of a syringe needle therethrough into the vial for removal of the vial contents therefrom.

8 Claims, 2 Drawing Sheets

BREAK AWAY OVERCAP

BACKGROUND OF THE INVENTION

This application is a continuation of application, Ser. No. 09/023,787, filed Feb. 13, 1998, of which is a C-I-P of patent application Ser. No. 08/713,028 filed Sep. 12, 1996, now U.S. Pat. No. 5,718,348 dated Feb. 17, 1998, owned by the same assignee as the instant application, there is disclosed an overcap assembly for a gear finish vial having a cap constructed and arranged to contain a stopper-type closure for the vial. A plurality of radially inwardly extending ribs are provided in the cap which cooperate with teeth on the gear finish to prevent turning of the cap assembly when in the sealing position on the vial. A plurality of inwardly extending tabs are provided on the lower end of the cap for engaging a shoulder on the vial neck for holding the overcap assembly downwardly in the sealed position on the neck of the vial.

The overcap of the present invention is an improvement on the above-noted overcap assembly in that the overcap assembly is now provided with a feature for easily and quickly removing the overcap from the sealed position on the vial, to thereby uncover the stopper-type closure, whereby a syringe needle can be inserted through the stopper into the vial for drawing the contents therefrom.

SUMMARY OF THE INVENTION

The break away overcap of the present invention comprises, essentially, an overcap assembly of the type disclosed in the above-noted pending application having a pair of spaced, parallel V-grooves or score lines extending across the top wall of the overcap and downwardly of the skirt to the lower edge thereof on each side of the cap. Thumb and index finger engaging portions are provided at the lower edge of the skirt in the space between the V-grooves. The cap is molded from a rigid, brittle plastic, such as polystyrene, whereby when the thumb and index finger engaging portions are pushed inwardly, the overcap breaks along the score lines, whereby the overcap is fractured into three pieces to thereby expose the stopper.

DESCRIPTION OF THE PREFERRED EMBODIMENTS

Figure 1:
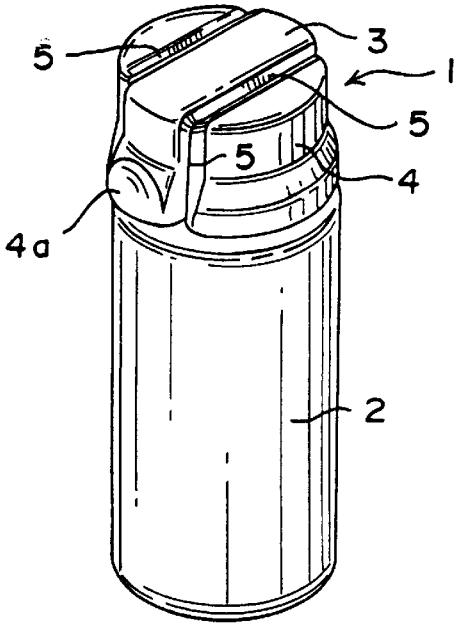
FIG. 1 is a perspective view of the break away overcap of the present invention sealing a stopper-type closure on a vial.

Referring to the drawings and, more particularly, to FIG. 1, the break away overcap of the present invention is adapted to be mounted on a vial 2 and is provided with a top wall 3 and a depending skirt 4. A pair of spaced, parallel V-grooves or score lines 5 extend across the top wall 3 of the overcap 1 and downwardly on each side of the skirt 4 to the lower edge thereof.

Figure 3:
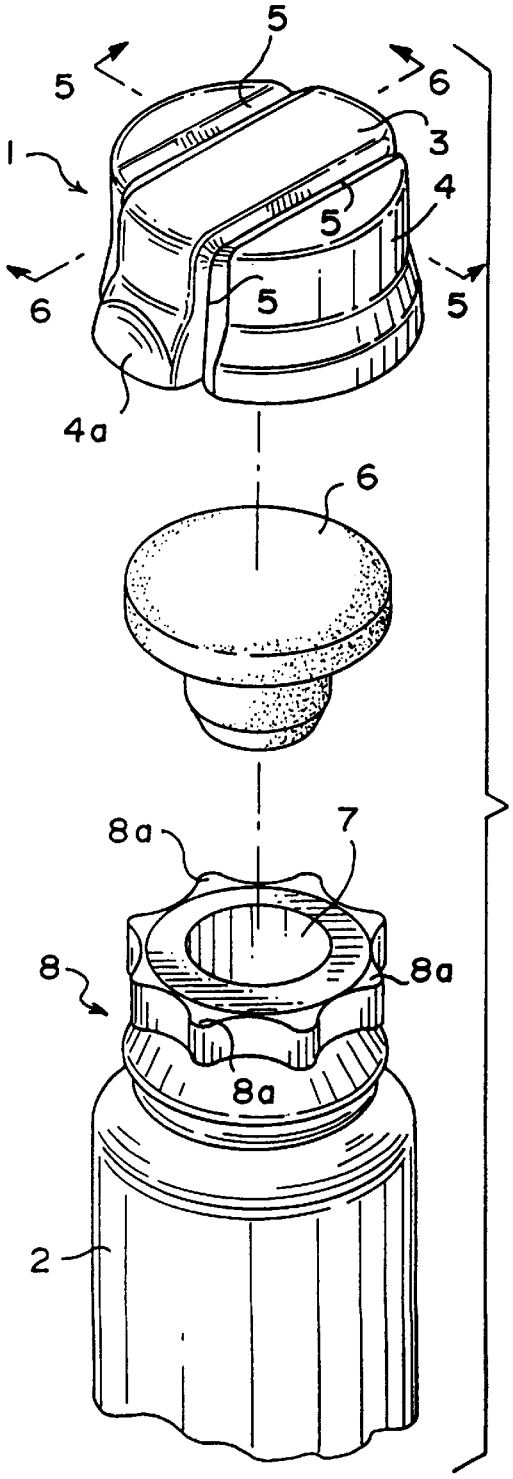
FIG. 3 is an exploded view of the break away overcap, the stopper, and gear finish vial.
Figure 4:
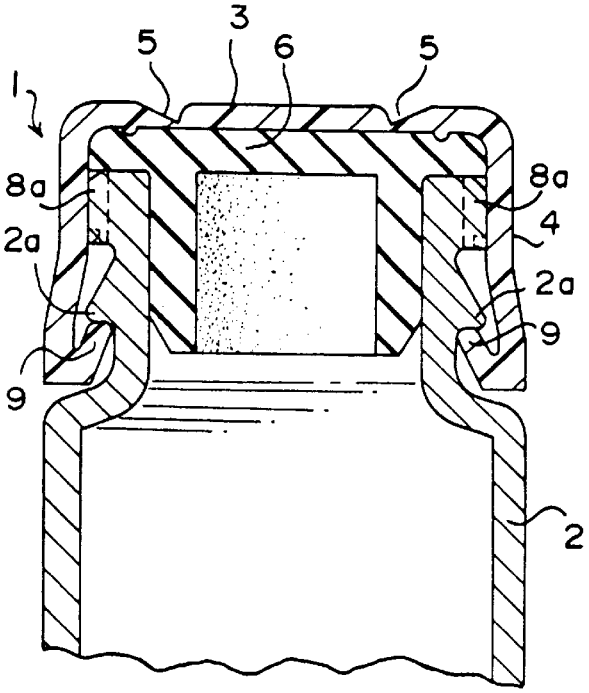
FIG. 4 is a fragmentary cross sectional view of the break away overcap in the assembled position on the vial.

As will be seen in FIGS. 3 and 4, the overcap 1 is adapted to maintain a stopper-type closure 6 in a sealed position within the open end 7 of the vial 2 having a gear finish 8 on the neck portion thereof, the gear finish 8 comprising a plurality of circumferentially spaced teeth 8*a*. While a stopper-type closure 6 is shown, it will be appreciated by those skilled in the art that a disc-type closure can also be employed in lieu of the stopper-type closure.

Figure 5:
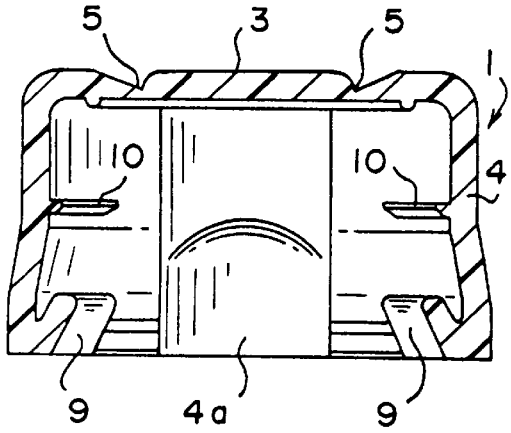
FIG. 5 is a view taken along line 5—5 of FIG. 3.
Figure 6:
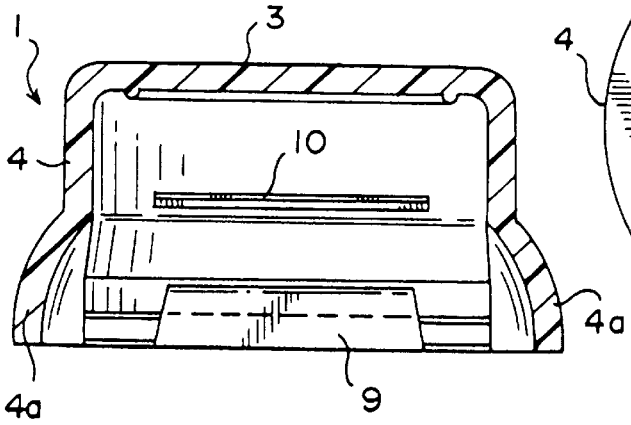
FIG. 6 is a view taken along line 6—6 of FIG. 3.
Figure 7:
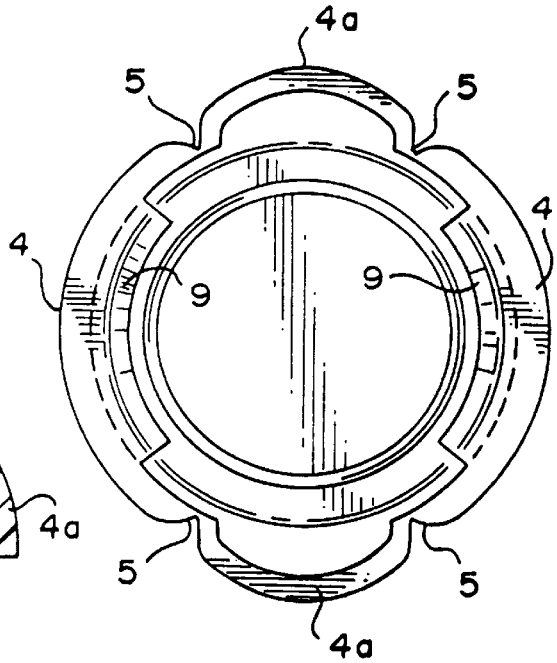
FIG. 7 is a bottom plan view of the overcap.

The details of the construction of the break away overcap 1 are illustrated in FIGS. 5 to 7 wherein it will be seen that a pair of diametrically opposed, upwardly inclined tabs 9 are integral with the lower edge portion of the cap skirt 4 and engage the lower surface of an outwardly extending shoulder 2*a* on the neck portion of the vial whereby the cap 1 is held in a sealed position on the vial 2. A plurality of circumferentially spaced, radially inwardly extending ribs 10 are integral with the inner surface of the cap skirt and enter the space between the gear teeth 8*a* to thereby prevent the break away cap 1 from turning when in the sealing position on the vial 2.

Figure 2:
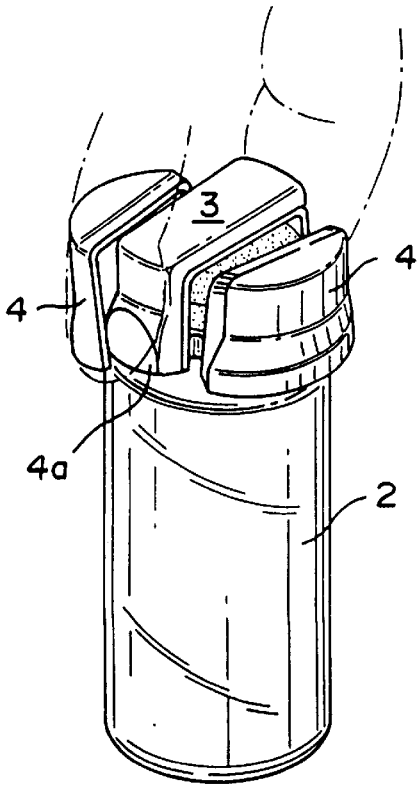
FIG. 2 is a perspective view showing the break away cap being fractured for removal from the vial.

As will be seen in FIGS. 6 and 7, the lower edge portion of the skirt 4 is provided with a pair of diametrically opposed radially outwardly extending enlarged portions 4*a* at the terminal ends of the score lines 5 providing thumb and index finger engaging areas for removal of the overcap 1 from the vial 2, which is illustrated in FIG. 2. Since the overcap 1 is molded from a rigid, brittle plastic, such as polystyrene, when the thumb and index finger of a user pushes the portions 4*a* of the skirt inwardly, the overcap 1 breaks along the score lines 5, whereby the overcap 1 fractures into three pieces, to thereby expose the stopper 6.

From the above description, it will be appreciated by those skilled in the art that the break away overcap of the present invention is an improvement on heretofore, employed overcaps in that the overcap of the present invention can be easily and quickly fractured for removal of the overcap from a sealing position on a vial, to thereby expose the closure for insertion of a syringe needle therethrough into a vial for removal of the contents therefrom.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

What is claimed is:

1. A cap assembly for a container made of a fracturable plastic comprising:

a top wall;

a skirt depending from the outer periphery of the top;

at least one score line extending across said top wall and downwardly along the skirt to a lower edge thereof;

at least one grasping portion on the lower edge of the skirt adjacent a terminal end of the score line whereby when at least one grasping portion is pushed inwardly, the cap fractures along said score line.

2. A cap assembly as claimed in claim 1 wherein a pair of spaced, parallel score lines extend across said top wall of the cap and downwardly of the skirt to the lower edge thereof on each side of the cap.

3. A cap assembly as claimed in claim 1 wherein a grasping portion comprises a thumb engaging portion and an index finger engaging portion on the lower edge of the skirt adjacent the terminal ends of the score lines.

4. A cap assembly as claimed in claim 1 wherein the score line comprises a V-shape groove.

5. A cap assembly as claimed in claim 1 wherein the grasping portion comprises a radially outwardly extending enlarged portion on the lower edge of said skirt.

6. A cap assembly as claimed in claim 1 including means for connecting the cap assembly to the neck of a vial comprising a plurality of inwardly and upwardly extending tabs integral with the lower end portion of said skirt and wherein the tabs are adapted to engage the bottom surface of a shoulder on the neck of a vial.

7. A cap assembly as claimed in claim 1 including a plurality of radially, inwardly extending ribs integral with the inner surface of the skirt portion, said ribs having portions extending into the space between gear teeth on the neck of a vial when the break away cap is mounted on a vial.

8. A cap assembly for a container made of a fracturable plastic comprising:

a top wall;

a skirt depending from the outer periphery of the top;

at least one score line extending across said top wall and downwardly along the skirt to a lower edge thereof;

at least one grasping portion on the lower edge of the skirt adjacent a terminal end of the score line whereby when at least one grasping portion is pushed inwardly, the cap fractures along said score line completely whereby the cap portions fall freely from a container.

* * * * *